US008900045B2

(12) United States Patent
Garretsen et al.

(10) Patent No.: US 8,900,045 B2
(45) Date of Patent: Dec. 2, 2014

(54) WAGERING GAME WITH SYMBOL SELECTION GAMEPIECE

(71) Applicant: Multimedia Games, Inc., Austin, TX (US)

(72) Inventors: William Garretsen, Cedar Park, TX (US); Brian Watkins, Austin, TX (US); Clint Owen, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 114 days.

(21) Appl. No.: 13/625,278

(22) Filed: Sep. 24, 2012

(65) Prior Publication Data

US 2014/0087818 A1 Mar. 27, 2014

(51) Int. Cl.
*G07F 17/32* (2006.01)

(52) U.S. Cl.
USPC ..... 463/16; 463/20; 463/25; 463/29; 463/31

(58) Field of Classification Search
USPC ..... 463/16, 20, 25, 29, 31
See application file for complete search history.

(56) References Cited

U.S. PATENT DOCUMENTS 4,582,324 A * 4/1986 Koza et al. ..... 463/16
6,251,013 B1 * 6/2001 Bennett ..... 463/13

* cited by examiner

*Primary Examiner* — Omkar Deodhar
(74) *Attorney, Agent, or Firm* — Nathan H. Calvert, Esq.; Russell D. Culbertson, Esq.; JP Cody, Esq.

(57) ABSTRACT

A gaming system, apparatus, and method are disclosed including a game feature with one or more symbol selection gamepieces, preferably presented as a graphical "Eye of the Pharaoh," which, when activated, causes a moving graphical effect to sequentially select various symbols in the gaming array. An interactive player input or a timeout may end the sequential selections, after which the symbol selection gamepiece selects a final selected symbol, on which is based a special award. Perceived-skill and actual-skill versions are disclosed.

18 Claims, 7 Drawing Sheets

WAGERING GAME WITH SYMBOL SELECTION GAMEPIECE

FIELD OF THE INVENTION

This invention relates to wagering games, gaming machines, networked gaming systems and associated methods. More particularly, the invention relates to wagering games, gaming devices, networked gaming systems, and associated methods including special game features that select symbols with moving graphical effects.

BACKGROUND

A large number of different gaming machines have been developed to provide various formats and graphic presentations for conducting games and presenting game results. Many past slot machine games have presented player interactive features designed to provide "perceived skill," that is to provide the impression that the player interaction with game elements has some skill-based outcome on the game. Typically, of course, true skill based games are not allowed under the regulatory schemes for games of chance (with exceptions such as blackjack and poker games), and the effect of the player's skill is only perceived, while the outcome is predetermined and may be reverse-mapped to fit choices made by the player. There continues to be a need to generate more player interest and excitement by providing new aspects to games.

SUMMARY OF THE INVENTION

The present invention includes wagering games, gaming machines, networked gaming systems and methods with one or more symbol selection gamepieces which allow player interaction in a manner that provides a game feature with one or more symbol selection gamepieces, preferably presented as a graphical "Eye of the Pharaoh," which, when activated, causes a moving graphical effect to sequentially select various symbols in the gaming array. An interactive player input or a timeout may end the sequential selections, after which the symbol selection gamepiece selects a final selected symbol, on which is based a special award. Both perceived-skill and actual-skill versions may exist. The symbol selection gamepiece may activate features such as a free spin bonus or a progressive award by selecting associated symbols.

Another version of the invention is a computer program stored on a non-transitory readable medium. The software version is, of course, typically designed to be executed by a gaming machine or networked gaming system. The software includes multiple portions of computer executable code referred to as program code. Gaming results are provided in response to a wager and displayed by display program code that generates simulated slot reels each including one or more symbol locations. The program also has game controller program code for determining game play results involving spins or other randomization of an array of symbols, and providing the selectable symbol selection gamepiece and its animations.

Another version of the invention is a gaming system that includes one or more gaming servers, and a group of electronic gaming machines connected to the servers by a network. The various functionality described herein may be distributed between the electronic gaming machines and the gaming servers in any practically functional way. For example, the current preferred architecture is for the servers to determine all aspects of game logic, random number generation, and prize awards. The gaming machines provide functionality of interfacing with the player and animating the game results to present the results received from the server in an entertaining manner. However, other embodiments of course might use a thin client architecture in which the animation is also conducted by the server and electronic gaming machines serve merely as a terminal to receive button or touchscreen input from the player and to display graphics received from the server.

Different features may be included in different versions of the invention. For example, while one symbol selection gamepiece feature is used in the embodiment below, a game might include several different features, all having different properties as to what prizes they award, how the moving graphical effect is depicted, and how the player interaction input is made and its effect.

These and other advantages and features of the invention will be apparent from the following description of the preferred embodiments, considered along with the accompanying drawings.

DETAILED DESCRIPTION OF PREFERRED EMBODIMENTS

Figure 1A:
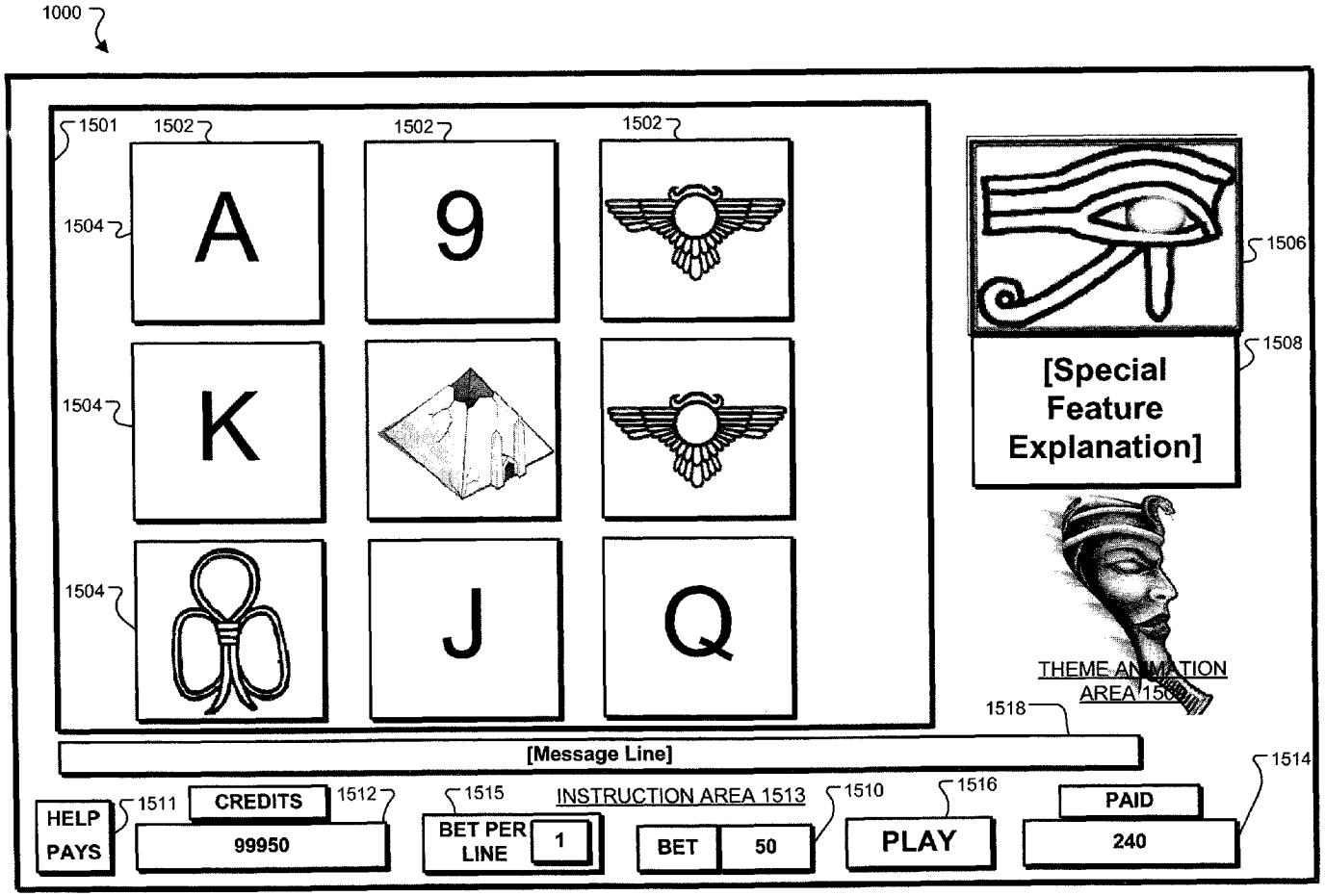
FIG. 1A is an example screenshot of primary display 1000 including an example reel game (Multimedia Games' Eye of the Pharaoh) with a symbol selection gamepiece.
Figure 1B:
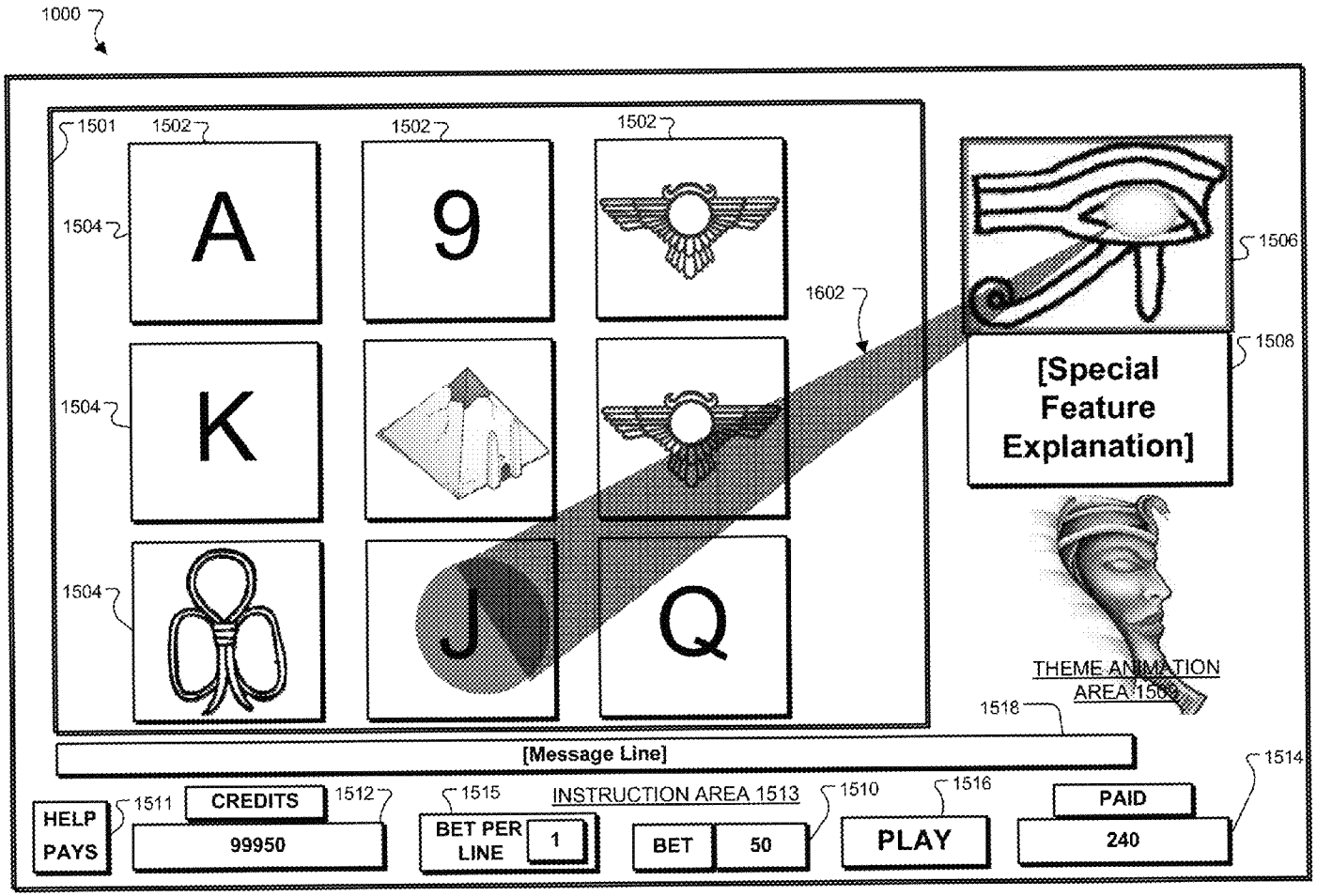
FIG. 1B is the example game result shown in FIG. 1A, with the Eye of the Pharaoh feature depicted as being activated.

FIG. 1A is an example screenshot of primary display 1000 including an example reel game (Multimedia Games' Eye of the Pharaoh) with a symbol selection gamepiece 1506. FIG. 1B is an example screenshot of the same primary game display, showing an example sequence of events depicting the features of the symbol selection gamepiece 1506. As will be further described below, once the gamepiece 1506 activates, it is animated to project a light which falls on various symbols in the matrix 1501. A player interaction input for the symbol selection gamepiece causes the gamepiece 1506 to settle or select a final symbol location 1504. The sequence of events will be further described with respect to the flowchart of FIG. 2.

In the diagram of FIG. 1A, game screen 1000 has a first gaming zone, which in this embodiment is a matrix of symbol locations 1501, in which is displayed the primary conduct of the base game. The matrix of symbol locations 1501 in this preferred version consists of nine simulated uni-symbol reels 1502, and each reel has one symbol location 1504. Next to the matrix of symbol locations 1501 is the symbol selection gamepiece 1506, which in the preferred Eye of the Pharaoh game described above is referred to as the Eye of the Pharaoh gamepiece.

Under the symbol selection gamepiece 1506 is the special feature explanation area 1508, which in the preferred Eye of the Pharaoh game contains text or graphics explaining the function of gamepiece 1506 or another special feature that might be active in the game according to game rules. Under the special feature explanation zone 1508 is a theme animation area 1509, which preferably shows animations related to the conduct or progress of the game, or its mode. In the various symbol locations 1504 in matrix 1501 can be seen certain symbols included in the Egyptian themed Eye of the Pharaoh game of the preferred embodiment. The symbols used, the number of symbol locations 1504 shown for each simulated reel 1502, and the size of the matrix 1501 may of course vary in different embodiments. Another preferred version uses five reels 1502 with four symbols 1504 shown on each reel, making a 5×4 matrix 1501, but with only one reel used for each column as opposed to the three uni-symbol reels used in each column in FIG. 1A.

Along the bottom of the diagram in FIG. 1A are found various game information and interaction buttons such as the current wager display 1510, available credits display 1512, the current payout display 1514, and the bet per line display 1515. The touchscreen play button 1516 may be used instead of the manual button shown on the example gaming cabinet in FIG. 3A. The Help/Pays button 1511 accesses the help screen and paytable information for the game. Along the bottom of the matrix 1501, there is a message line 1518 for showing current messages to the player from the game or gaming network. Between the message line 1518 and the lower display items is an instruction area 1513 which is updated to display various instructions or feature explanations regarding the game.

FIG. 1B is the example game result shown in FIG. 1A, with the Eye of the Pharaoh feature (the symbol selection gamepiece 1506) depicted as being activated. As shown, the gamepiece 1506 is animated to depict that the feature is active, in this case by enlarging the "eye" area of the graphic, and then the gaming zone 1501 is animated along with the gamepiece 1506 to show a moving graphical effect 1602, which in this case is depicted as a light emanating from the eye and shining on different symbols 1504 sequentially. The function of the symbol selection gamepiece 1506 is further described below.

Figure 2:
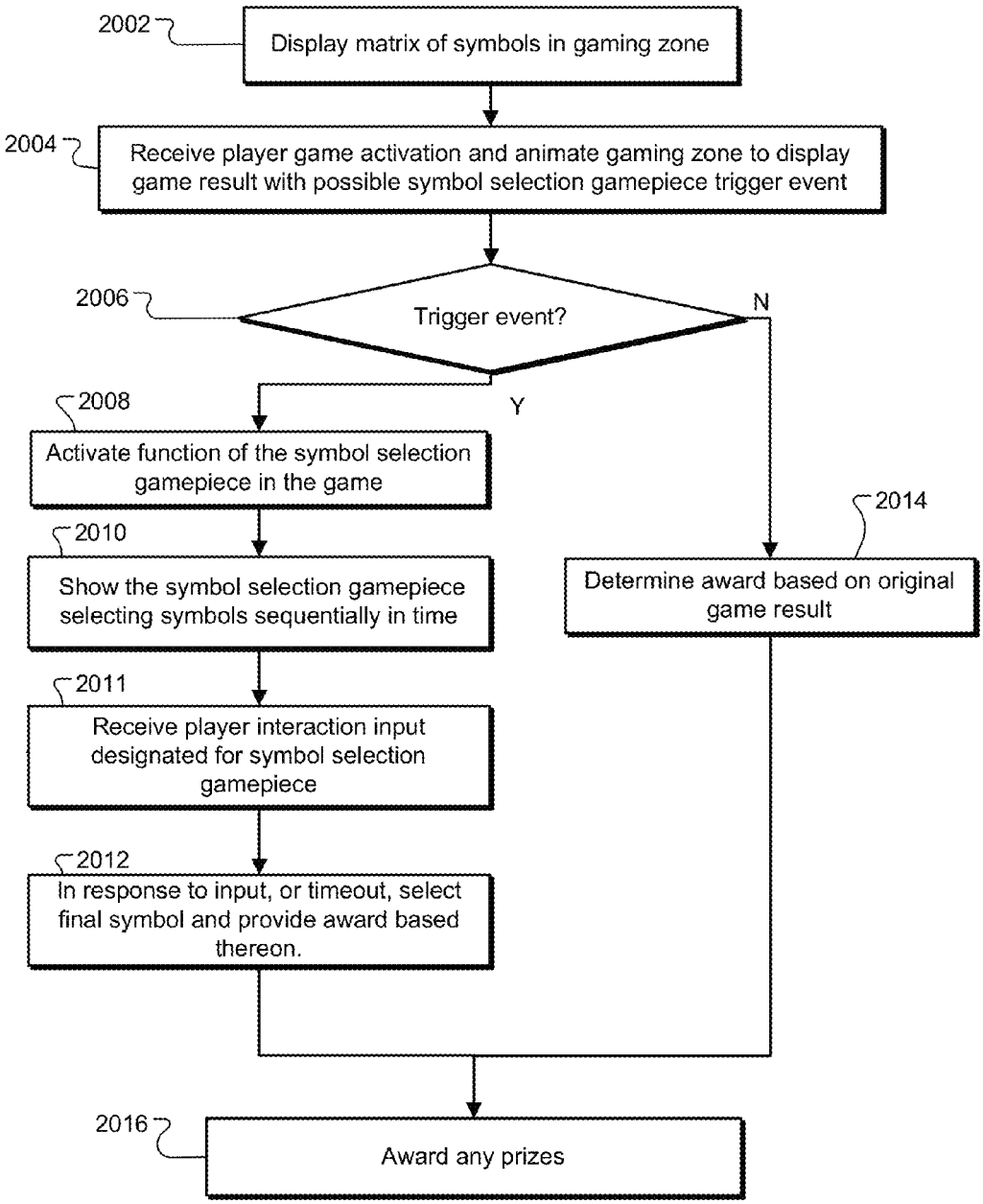
FIG. 2 is a flowchart showing an example of the game play process at a gaming machine that includes the symbol selection gamepiece feature according to an example embodiment.

FIG. 2 is a flowchart showing an example of the game play process at a gaming machine that includes the symbol selection gamepiece feature according to an example embodiment. This flowchart includes the symbol selection gamepiece functionality for the preferred game embodiment known as Eye of the Pharaoh and depicted in the above Figures. The process starts at step 2002 where the game displays an arrangement of symbols which are updated to show play of the game. This display is achieved by controlling a touch sensitive gaming display with one or more electronic processors under the control of suitable program code, such as is done with the preferred gaming machine embodiment shown in FIG. 3A. The gaming display including a first gaming zone includes a matrix of symbol locations which will be updated to provide results of the game in response to a player game activation including a wager (step 2004). The gaming display shown at this step further includes a symbol selection gamepiece zone outside of the gaming zone, which is animated to reflect the state in the game of the symbol selection gamepiece. The state may be inactive, active and sequentially selecting symbols, or active and resting on a final symbol selection, as will be further described below. At step 2004, the game may be played repeatedly by activating wagers, and provides outcomes without a symbol selection gamepiece trigger event. In the depicted sequence, the process receives a first player game activation and, in response, animates the first gaming zone to show a first game result in the symbol locations, the game result having a chance to include a symbol selection gamepiece trigger event. The process determines whether such a trigger event occurred at step 2006. In the case that this step finds a symbol selection gamepiece trigger event, the process activates a function of the symbol selection gamepiece at step 2008.

While in some embodiments the symbol selection gamepiece may include more than one function, in this version the gamepiece is animated as an "Eye of the Pharaoh" graphic, the function of which is that the eye is shown to open and cast a gaze or light on several gamepieces sequentially (the moving graphical effect 1602 shown above), eventually stopping on one and providing a prize therefore. The light is shown to move and swerve among symbols in the matrix. Preferably, the player may make an input for which the process responds by stopping the sequential selection. As shown in the flowchart, the process at step 2010 animates the second symbol selection gamepiece zone and the first gaming zone to show the symbol selection gamepiece sequentially in time making a temporary selection of various ones of the symbols in the matrix of symbol locations. Next at step 2011, while the movement of the graphical effect 1602 (such as the light from Pharaoh's eye) and the sequential selection of symbols is still occurring, the player may make an input to try and stop the effect on a preferred symbol. At step 2011, the process receives such a player interaction input designated for the symbol selection gamepiece, and in response, or if no player interaction input is received after a determined amount of time has passed, the process at step 2012 stops the sequential selections to choose a final selected symbol. This is preferably shown by the animated effect such as the light from Pharaoh's eye stopping on a symbol. In the game, an award is provided at this step based on the final selected symbol.

Receiving the player interaction input at step 2011 may occur in a variety of ways. In preferred games, the input is a "perceived skill" type of input which does not change the already-determined outcome of the game, and instead only changes the animated display of the game result presentation by causing the sequential selection of symbols to end. It ends, however, after a movement to the originally intended final symbol. Other games may include an actual skill element in which the player presses a button, a touchscreen object, or the actual symbol desired on the screen while, or just before, the effect 1602 reaches the desired symbol. This has the effect of stopping the sequential selection if the player interaction input was conducted within a designated time window for the particular desired final symbol. In such version, the touch may be seen to cause the moving graphical effect 1602 to begin slowing and stopping, but it may finally rest on the player's desired symbol or another final symbol. Some versions may not include a player interaction input and instead may go from step 2010 to step 2012, where a designated timeout, which may vary in length, determines the end of the sequential selection process. Such a timeout is used in versions that do not include a player interaction input, to handle the case in which the player makes no input.

Further, the final symbol selected at step 2012 may provide different features other than a straightforward credit award. For example, if the graphical effect 1602 selects a special symbol such as a bonus symbol, a bonus game or feature may result, without requiring a winning pattern comprised of the bonus symbol. In one preferred version, a base game includes a free spin bonus if a winning pattern includes a designated number of free spin symbols, in this case three. However, if graphical effect 1602 selects the free spin symbol, even if only a single symbol appeared in the result and resulted in no award, the selection provides a backdoor entry to the associated bonus and provides a free spin round. Other bonus symbol features may be similarly triggered as a "back door" to the bonus feature. In other embodiments, the graphical effect 1602 may select a final symbol that results in a progressive award. Such a game may provide a special progressive award designated only for when the final symbol is selected in such a manner, or may provide the progressive as an alternate way to win a progressive award that is typically won by a winning pattern of designated bonus symbols.

Finally, at step 2016, the process pays an award if the game result is a winning game outcome. If no trigger event occurs at step 2006, the process of course goes to step 2014 where it determines the award based on the original game result by applying the remaining game rules, and then proceeds to step 2016 where any prize that is due is awarded.

Figure 3A:
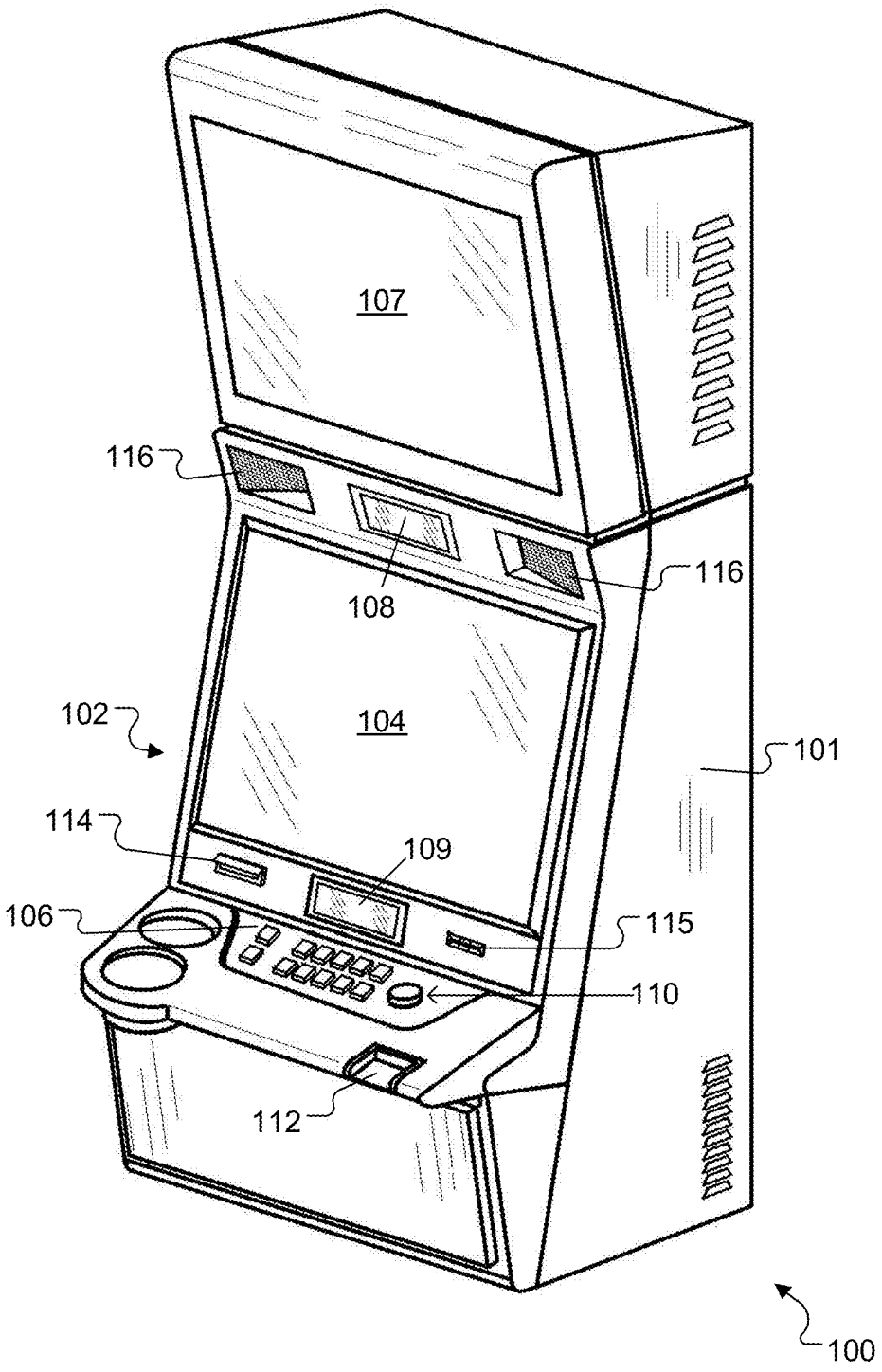
FIG. 3A is a front perspective view of a gaming machine which may be used in a gaming system embodying the principles of the present invention.
Figure 3B:
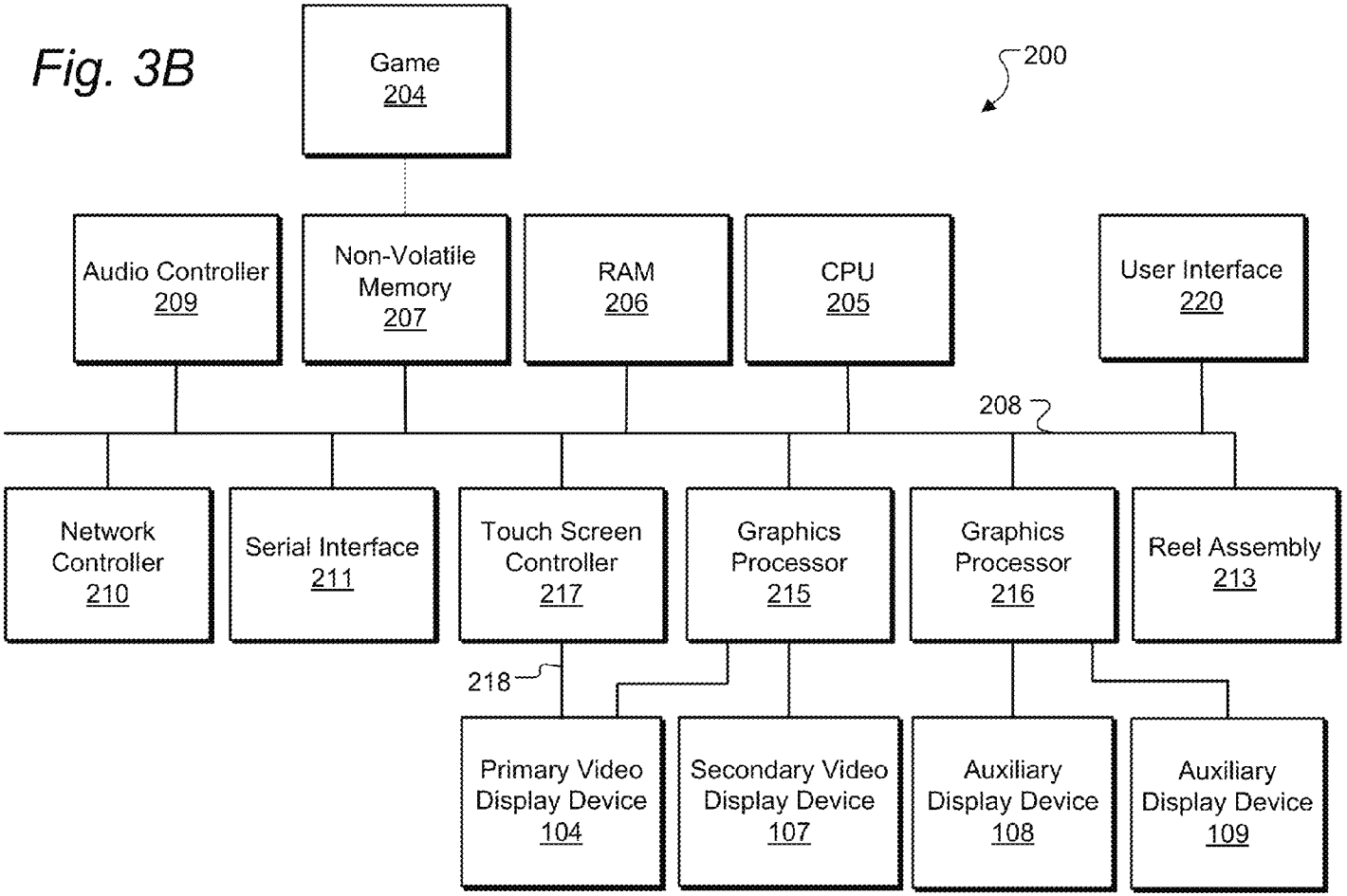
FIG. 3B is a block diagram showing various electronic components of the gaming machine shown in FIG. 3A together with additional gaming system components.

FIG. 3A shows a gaming machine 100 that may be used to implement a symbol selection gamepiece game feature according to the present invention. The block diagram of FIG. 3B shows further details of gaming machine 100. Referring to FIG. 3A, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 3A also includes a number of mechanical control buttons 110 mounted on ledge 106. These control buttons 110 may allow a player to select a bet level, select paylines, select a type of game or game feature, and actually start a play in a primary game. Further, primary video display device 104 in gaming machine 100 provides a convenient display device for implementing touchscreen controls.

It will be appreciated that gaming machines may also include a number of other player interface devices in addition to devices that are considered player controls for use in playing a particular game. The ledge may also include a hardware special object including a button, touch sensor, or switches, joysticks, or other mechanical input devices, and/or virtual buttons and other controls implemented on a suitable touchscreen video display. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 3B shows a logical and hardware block diagram 200 of gaming machine 100 which includes a central processing unit (CPU) 205 along with random access memory 206 and nonvolatile memory or storage device 207. All of these devices are connected on a system bus 208 with an audio controller 209, a network controller 210, and a serial interface 211. A graphics processor 215 is also connected on bus 208 and is connected to drive primary video display device 104 and secondary video display device 107 (both mounted on cabinet 101 as shown in FIG. 3A). A second graphics processor 216 is also connected on bus 208 in this example to drive the auxiliary display devices 108 and 109 also shown in FIG. 3A. As shown in FIG. 3B, gaming machine 100 also includes a touch screen controller 217 connected to system bus 208. Touch screen controller 217 is also connected via signal path 218 to receive signals from a touchscreen element associated with primary video display device 104. It will be appreciated that the touchscreen element itself typically comprises a thin film that is secured over the display surface of primary video display device 104. The touchscreen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 3B are elements commonly associated with a personal computer. These elements are preferably mounted on a standard personal computer chassis and housed in a standard personal computer housing which is itself mounted in cabinet 101 shown in FIG. 3A. Alternatively, the various electronic components may be mounted on one or more circuit boards housed within cabinet 101 without a separate enclosure such as those found in personal computers. Those familiar with data processing systems and the various data processing elements shown in FIG. 3B will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 3B as being connected directly on system bus 208 may in fact communicate with the other system components through a suitable expansion bus. Audio controller 209, for example, may be connected to the system via a PCI bus. System bus 208 is shown in FIG. 3B merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. In some embodiments, the symbol selection gamepiece may be displayed on secondary video display 107 rather than beside the matrix of symbol locations or other type of primary gaming zone on the primary display. The invention is not limited to any particular arrangement of processing devices for controlling the video display device included with gaming machine 100. Also, a gaming machine implementing the present invention is not limited to any particular number of video display devices or other types of display devices.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller for performing functions associated with a primary game that may be available through the gaming machine, and may also implement a game client for directing one or more display devices at the gaming machine to display portions of a symbol selection gamepiece game according to the present invention. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs, while the nonvolatile memory or storage device 207 may comprise a hard drive or other mass storage device providing storage for programs not in use or for other data generated or used in the course of gaming machine operation. Network controller 210 provides an interface to other components of a gaming system in which gaming machine 100 is included. In particular, network controller 210 provides an interface to a game controller which controls certain aspects of the symbol selection gamepiece game as will be discussed below in connection with FIG. 4A.

It should be noted that the invention is not limited to gaming machines employing the personal computer-type arrangement of processing devices and interfaces shown in example gaming machine 100. Other gaming machines through which a symbol selection gamepiece feature is implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. It is possible to implement a symbol selection gamepiece feature within the scope of the present invention using an electro mechanical arrangement or even a purely mechanical arrangement for displaying the symbols or first and second animations or reactions needed to complete the symbol selection gamepiece game as described herein. For example, a physical light may be manipulated by servo motors to shine on mechanical reels or simulated reels. However, the most preferred forms of the invention utilize one or more video display devices for displaying the spinning reels and the selectable modifier elements. For example, a gaming machine suitable for providing a symbol selection gamepiece game may include a mechanical reel-type display rather than a video-type display device for displaying results in a primary game, and include another mechanical or display feature for presenting the symbol selection gamepiece separately.

Still referring to the hardware and logical block diagram 200 showing an example design for a gaming machine 100, the depicted machine in operation is controlled generally by CPU 205 which stores operating programs and data in memory 207 with wagering game 204, user interface 220, network controller 210, audio/visual controllers, and reel assembly 213 (if mechanical reel configuration). CPU or game processor 205 may comprise a conventional microprocessor, such as an Intel Pentium microprocessor, mounted on a printed circuit board with supporting ports, drivers, memory, software, and firmware to communicate with and control gaming machine operations, such as through the execution of coding stored in memory 207 including one or more wagering games 204. Game processor 205 connects to user interface 220 such that a player may enter input information, and game processor 205 may respond according to its programming, such as to apply a wager and initiate execution of a game.

Figure 4A:
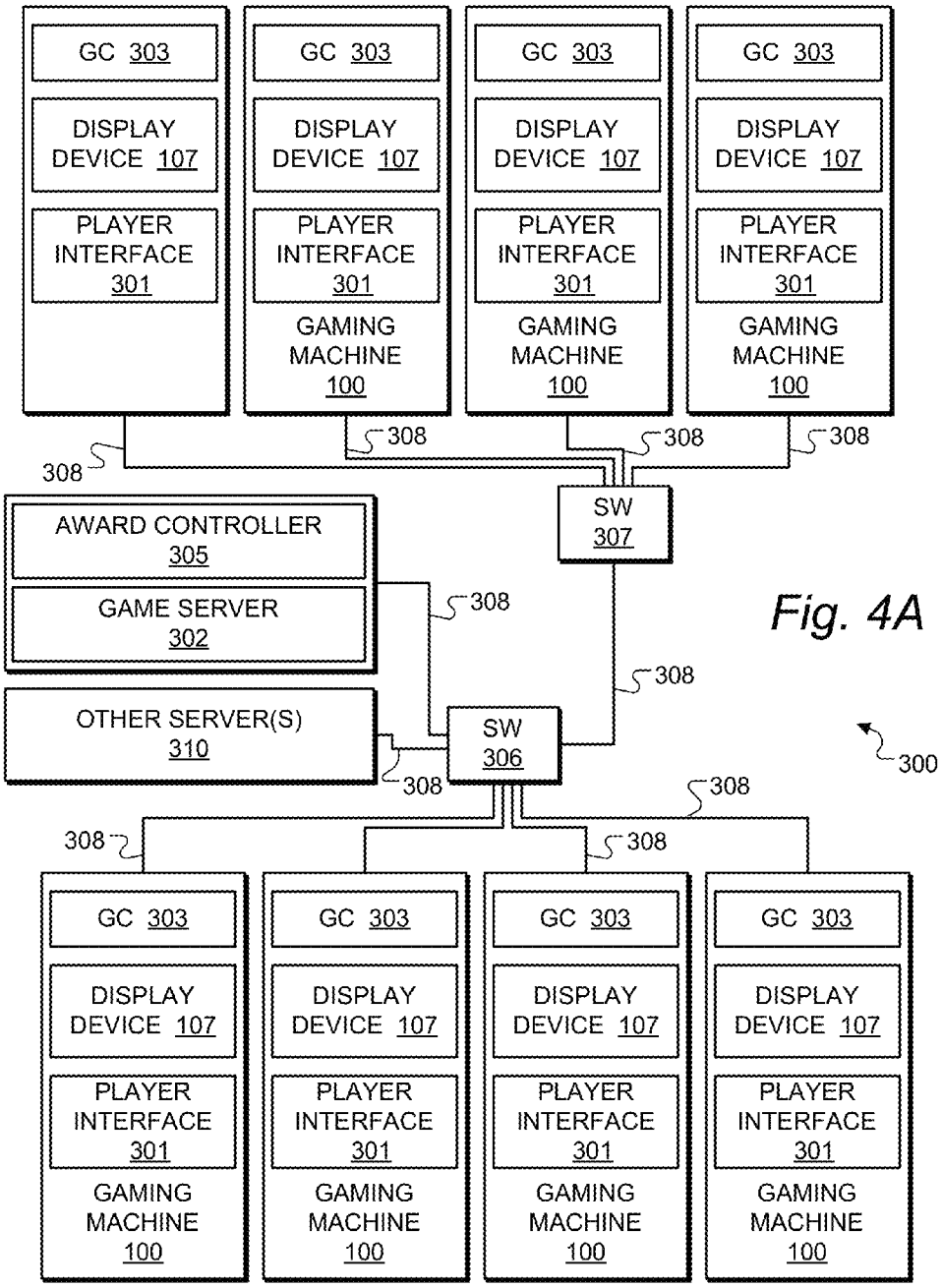
FIG. 4A is a system block diagram of a gaming system according to one embodiment of the present invention.
Figure 4B:
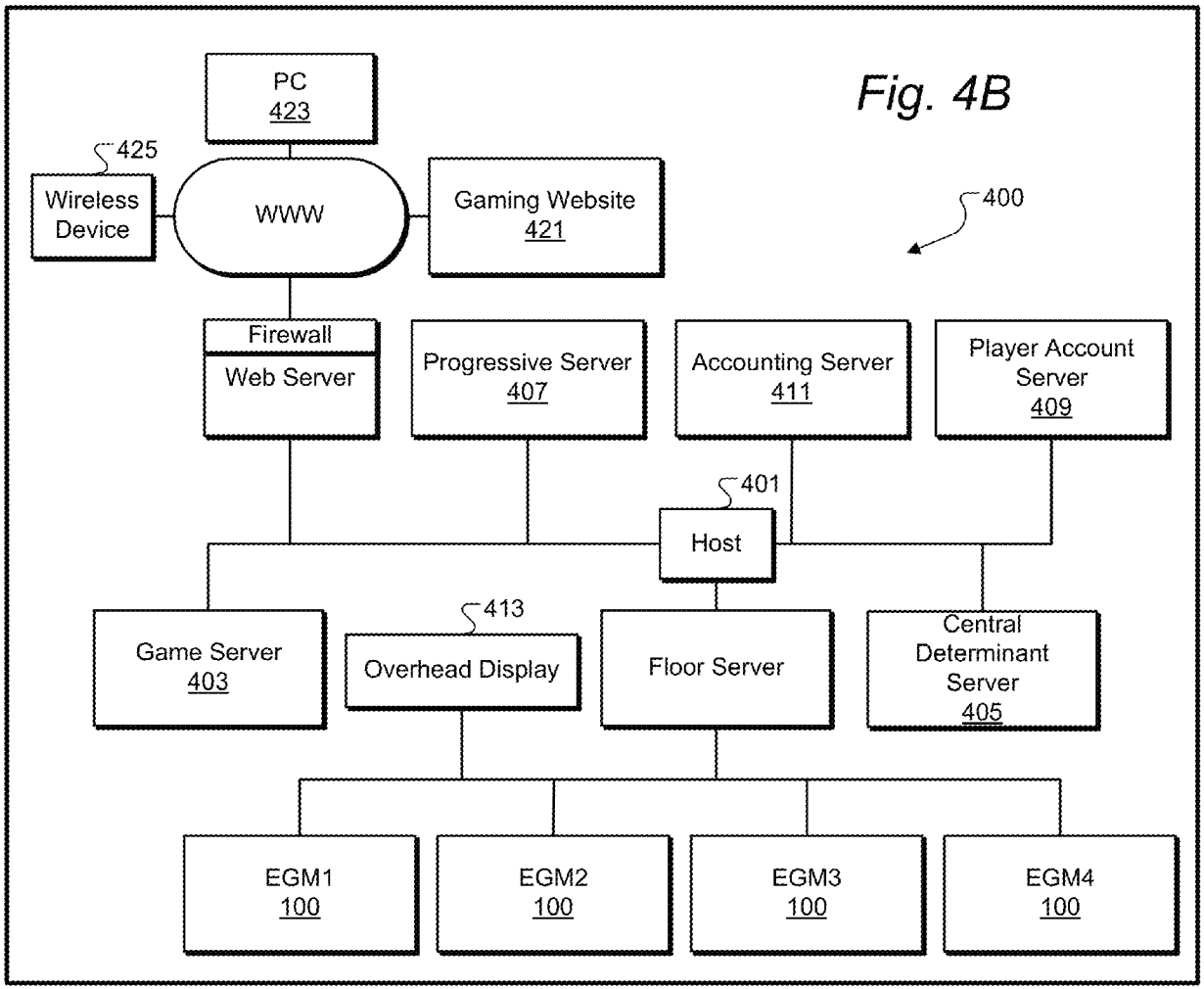
FIG. 4B is a system block diagram of a gaming system according to another embodiment.

Game processor 205 also may connect through network controller 210 to a gaming network, such as example casino server network 400 shown in FIG. 4B. Referring now to FIG. 4B, the casino server network 400 may be implemented over one or more site locations and include host server 401, remote game play server 403 (which may be configured to provide game processor functionality including determining game outcomes and providing audio/visual instructions to a remote gaming device), central determinant server 405 (which may be configured to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

Referring now to FIG. 4A, a gaming system 300 according to another embodiment of the present invention is shown again in a network and system diagram format. System 300 includes a number of gaming machines, each comprising a gaming machine 100 in this example implementation. For purposes of describing system 300, each gaming machine 100 in FIG. 4A is shown as including a video display device 107 and a player interface 301 that may include buttons, switches, or other physical controls and/or touchscreen controls as discussed above in connection with FIG. 4A. System 300 further includes a game server 302 and a respective game client 303 (abbreviated "GC" in FIG. 4A) included with each respective gaming machine 100. In the form of the invention shown in FIG. 4A, these two components, game server 302 and the game client components 303, combine to implement a game control arrangement which will be described in detail below. System 300 also includes an award controller 305, which is shown in FIG. 4A as being associated with game server 302 to indicate that the two components may be implemented through a common data processing device/computer system. Gaming machines 100, game server 302, and award controller 305 are connected in a network communication arrangement including first and second network switches 306 and 307, connected together through various wired or wireless signal paths, all shown as communications links 308 in FIG. 4A.

Each gaming machine 100, and particularly player interface 301 associated with each gaming machine, allows a player to make any inputs that may be required to make the respective gaming machine eligible for a symbol selection gamepiece feature, and make the player interaction inputs employed at the respective gaming machine in the course of the symbol selection gamepiece game. Player interface 301 also allows a player at the gaming machine to initiate plays in a primary game available through the gaming machine in some implementations. The respective video display device 107 associated with each respective gaming machine 100 is used according to the invention to generate the graphic displays to show the various elements of a symbol selection gamepiece feature at the respective gaming machine.

The game control arrangement made up of game server 302 and the respective game client 303 at a given gaming machine functions to control the respective video display device 107 for that gaming machine to display a number of selectable modifier objects. Award controller 305 is responsible for awarding prizes for a player's participation in the game, and maintaining progressive prize information where the symbol selection gamepiece game offers one or more progressive prizes. The network arrangement made up of network switches 306 and 307, and the various communication links 308 shown in FIG. 4A is illustrated merely as an example of a suitable communications arrangement. It should be noted that the game control arrangement, or as it is referred to generally the "game controller," may be implemented in some embodiments entirely on the gaming machine. This is especially true in jurisdictions that allow Class III gaming conducted with random number generators at each gaming machine. The present invention is not limited to any particular communications arrangement for facilitating communications between game server 302 and various gaming machines 100. Any wired or wireless communication arrangement employing any suitable communications protocols (such as TCP/IP for example) may be used in an apparatus according to the invention.

FIG. 4A shows other server(s) 310 included in the network. This illustrated "other server(s)" element 310 may include one or more data processing devices for performing various functions related to games conducted through system 300 and any other games that may be available to players through gaming machines 100. For example, apparatus 300 may be accounting servers providing support for cashless gaming or various forms of mixed cash/cashless gaming through the various gaming machines 100. In this example, an additional one of the other servers 310 will be included in apparatus 300 for supporting these types of wagering and payout systems. As another example, the various gaming machines 100 included in system 300 may allow players to participate in a game (primary game) other than the symbol selection gamepiece game described herein, and this other game may rely on a result identified at or in cooperation with a device that is remote from the gaming machines. In this example, another server 310 may be included in the system for identifying results for the primary game and communicating those results to the various gaming machines 100 as necessary. Generally, the other server(s) 310 shown in FIG. 4A are shown only to indicate that numerous other components may be included along with the elements that participate in providing symbol selection gamepiece feature games according to the present invention. Other server(s) 310 may provide record keeping, player tracking, accounting, result identifying services, or any other services that may be useful or necessary in a gaming system.

Referring to FIG. 4B, a block diagram of another example networked gaming system 400 associated with one or more gaming facilities is shown, including one or more networked gaming machines 100 in accordance with one or more embodiments. With reference to FIG. 4B, while a few servers have been shown separately, they may be combined or split into additional servers having additional capabilities.

As shown, networked gaming machines 100 (EGM1-EGM4) and one or more overhead displays 413 may be network connected and enable the content of one or more displays of gaming machines 100 to be mirrored or replayed on an overhead display. For example, the primary display content may be stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective player's video images may be displayed on overhead display 413 along with the content of the player's display 104 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e.g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Blackberry cell phone, Apple iPhone, personal data assistant (PDA), iPad, etc.). To enter the website, a player may log in with a username (that may be associated with the player's account information stored on player account server 409 or be accessible by a casino operator to obtain player data and provide promotional offers), play various games on the website, make various personalizing selections and save the information, so that during a next gaming session at a casino establishment, the player's playing data and personalized information may be associated with the player's account and accessible at the player's selected gaming machine 100.

Referring generally to the description herein, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for providing a wagering game including:

(a) controlling a touch sensitive gaming display with one or more electronic processors, the gaming display including a first gaming zone comprising a matrix of symbol locations which are updated to provide results of the game by showing graphic symbols, the gaming display further comprising a second symbol selection gamepiece zone outside of the first gaming zone for reflecting the state of a symbol selection gamepiece;

(b) receiving a first player game activation and, in response, animating the first gaming zone to show a first game result in the symbol locations, the game result having a chance to include a symbol selection gamepiece trigger event;

(c) in the case that (b) resulted in a symbol selection gamepiece trigger event, activating a function of the symbol selection gamepiece in the game by (i) animating the second symbol selection gamepiece zone and the first gaming zone to show the symbol selection gamepiece sequentially in time making a temporary selection of various ones of the symbols in the matrix of symbol locations, and (ii) receiving a player interaction input designated for the symbol selection gamepiece, and (iii) in response to receiving the player interaction input, or if no player interaction input is received, after a determined amount of time has passed, stopping the sequential selections of the symbol selection gamepiece to choose a final selected symbol, and (iv) providing an award based on the final selected symbol; and (d) paying an award if the game result is a winning game outcome.

2. The method of claim 1, in which the animation showing temporary selections sequentially in time includes showing a graphical effect moving through the matrix of symbol locations.

3. The method of claim 2, wherein the graphical effect is shown to originate from the second symbol selection gamepiece zone.

4. The method of claim 1, in which receiving a player interaction input comprises receiving a touchscreen input touching a graphical effect associated with the symbol selection gamepiece.

5. The method of claim 1, in which the symbol selection gamepiece trigger event is a mystery event for which no visual designation of why the event occurred is shown to a player.

6. The method of claim 1, further comprising assigning a designated award for each possible symbol when used as the final selected symbol and providing a manner for a player to learn such designated awards.

7. The method of claim 6, in which the animation showing temporary selections sequentially in time includes showing a graphical effect moving through the matrix of symbol locations.

8. The method of claim 1, in which the final selected symbol is a free spin bonus symbol, and the award provided is done by providing a free spin bonus game to a player.

9. The method of claim 1, in which the final selected symbol is a bonus symbol designated for awarding a progressive, and the selection of the final selected symbol by the symbol selection gamepiece causes a progressive award to be awarded.

10. A program product embodied in one or more tangible non-transitory computer readable media, the program product including code executable by a gaming machine and at least one gaming server for:

(a) controlling a touch sensitive gaming display with one or more electronic processors, the gaming display including a first gaming zone comprising a matrix of symbol locations which are updated to provide results of the game by showing graphic symbols, the gaming display further comprising a second symbol selection gamepiece zone outside of the first gaming zone for reflecting the state of a symbol selection gamepiece;

(b) receiving a first player game activation and, in response, animating the first gaming zone to show a first game result in the symbol locations, the game result having a chance to include a symbol selection gamepiece trigger event;

(c) in the case that (b) resulted in a symbol selection gamepiece trigger event, activating a function of the symbol selection gamepiece in the game by (i) animating the second symbol selection gamepiece zone and the first gaming zone to show the symbol selection gamepiece sequentially in time making a temporary selection of various ones of the symbols in the matrix of symbol locations, and (ii) receiving a player interaction input designated for the symbol selection gamepiece, and (iii) in response to receiving the player interaction input, or if no player interaction input is received, after a determined amount of time has passed, stopping the sequential selections of the symbol selection gamepiece to choose a final selected symbol, and (iv) providing an award based on the final selected symbol; and (d) paying an award if the game result is a winning game outcome.

11. The program product of claim 10, in which the animation showing temporary selections sequentially in time includes showing a graphical effect moving through the matrix of symbol locations.

12. The program product of claim 11, wherein the graphical effect is shown to originate from the second symbol selection gamepiece zone.

13. The program product of claim 10, in which receiving a player interaction input comprises receiving a touchscreen input touching a graphical effect associated with the symbol selection gamepiece.

14. The program product of claim 10, in which the symbol selection gamepiece trigger event is a mystery event for which no visual designation of why the event occurred is shown to a player.

15. The program product of claim 10, further comprising assigning a designated award for each possible symbol when used as the final selected symbol and providing a manner for a player to learn such designated awards.

16. The program product of claim 15, in which the animation showing temporary selections sequentially in time includes showing a graphical effect moving through the matrix of symbol locations.

17. The program product of claim 10, in which the final selected symbol is a free spin bonus symbol, and the award provided is done by providing a free spin bonus game to a player.

18. The program product of claim 10, in which the final selected symbol is a bonus symbol designated for awarding a progressive, and the selection of the final selected symbol by the symbol selection gamepiece causes a progressive award to be awarded.

* * * * *